United States Patent [19]

Egging et al.

[11] Patent Number: 5,044,639

[45] Date of Patent: Sep. 3, 1991

[54] BALL GAME WITH PLAYER CONTROLLED REBOUND SURFACE

[75] Inventors: Keith J. Egging, Itasca; Chester F. Robards, Jr., Roselle, both of Ill.

[73] Assignee: Taito America Corporation, Wheeling, Ill.

[21] Appl. No.: 530,890

[22] Filed: May 29, 1990

[51] Int. Cl.[5] ..... A63B 67/00

[52] U.S. Cl. ..... 273/342

[58] Field of Search ..... 273/342, 148 B

[56] References Cited

U.S. PATENT DOCUMENTS

| | | | |
|---|---|---|---|
| 2,004,290 | 6/1935 | McCollough et al. | 273/342 |
| 2,404,652 | 7/1946 | Plebanek . | |
| 2,998,673 | 9/1961 | Rhodes | 273/342 X |
| 3,761,089 | 9/1973 | Slane . | |
| 3,782,729 | 1/1974 | Ernst . | |
| 4,509,383 | 4/1985 | Yeh | 273/148 B X |

FOREIGN PATENT DOCUMENTS 2140033 2/1973 Fed. Rep. of Germany .

*Primary Examiner*—William H. Grieb

*Attorney, Agent, or Firm*—Willian Brinks Olds Hofer Gilson & Lione

[57] ABSTRACT

A game of the type having a large number of balls, a set of targets responsive to contact with the balls, and a scoring mechanism for keeping a score associated with contact between the balls and the targets further includes a tiltable rebound surface. A ball pump raises the balls from an input to an elevated output and discharges the balls from the output to cause the balls to fall in space onto the rebound surface. A user controlled steering mechanism is coupled to the rebound surface to allow a user to tilt the rebound surface as the balls fall onto the rebound surface in order to direct the balls that bounce off of the rebound surface against selected ones of the targets. The ball pump includes a rotatable drive element that is movably mounted adjacent a ball guide to frictionally engage the balls and advance the balls towards the outlet of the ball pump.

22 Claims, 4 Drawing Sheets

BALL GAME WITH PLAYER CONTROLLED REBOUND SURFACE

BACKGROUND OF THE INVENTION

This invention relates to a ball game of a type that may be used in place of conventional pin ball machines or video games, and which includes a steerable rebound surface.

There have been a number of efforts in the prior art to develop games based on balls which fall onto a rebound surface and then onto a target. Note for example the games shown in Plebanek U.S. Pat. No. 2,404,652, Slane U.S. Pat. No. 3,761,089 and Ernst U.S. Pat. No. 3,782,729. In each case a falling ball is directed onto a rebound surface, and the ball rebounds from the rebound surface onto a target.

In each of these games the rebound surface is stationary during play, and none of these games allows a user to steer the rebound surface during play in order to direct the balls onto user selectable targets during the play of the game.

SUMMARY OF THE INVENTION

The present invention is directed to a new type of game which allows the user to reposition a rebound surface so as to direct falling balls onto a target.

This invention relates to a game of the type comprising a plurality of balls, a plurality of targets responsive to interaction with the balls, and a scoring mechanism for keeping a score associated with interaction between the balls and the targets. According to this invention, the game further comprises a movable rebound surface and a raising mechanism having an input at a lower elevation and an output at a higher elevation. This raising mechanism raises the balls from the input to the output and discharges the balls from the output onto the rebound surface. A user controlled steering mechanism is coupled to the rebound surface to allow a user to move the rebound surface during play in order to direct the balls that bounce off the rebound surface against selected ones of the targets.

This invention is also directed to the improved ball raising mechanism described below.

In the preferred embodiment described below the balls are continuously discharged so that they fall onto the rebound surface in a measured, evenly spaced sequence that presents (under certain conditions) the illusion of substantially continuous stream. In this embodiment the steering mechanism comprises a joy stick, and the user can continually adjust the orientation of the rebound surface with the joy stick during play in order to direct the balls that bounce off of the surface against the targets.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
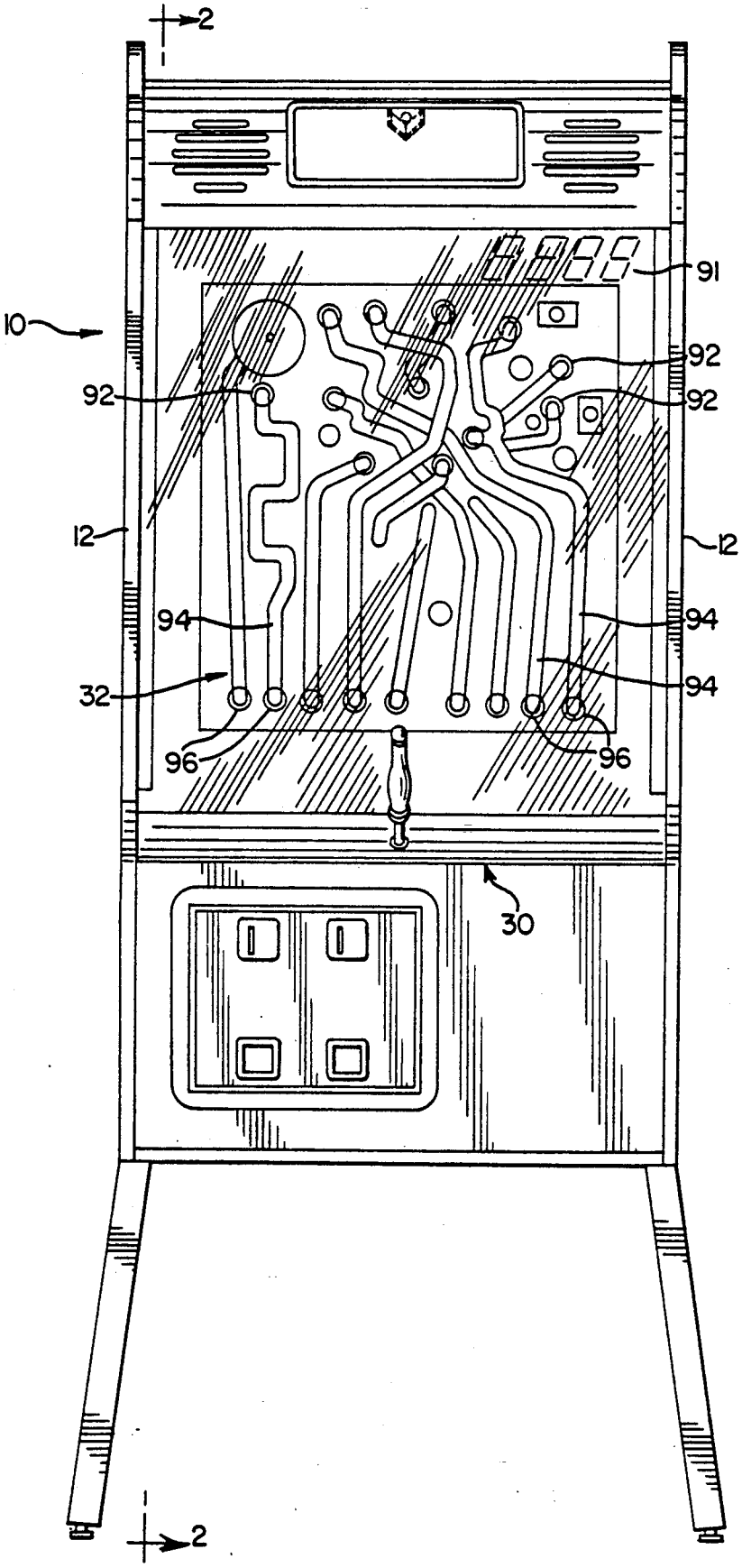
FIG. 1 is a front elevational view of a game which incorporates a presently preferred embodiment of the present invention.
Figure 2:
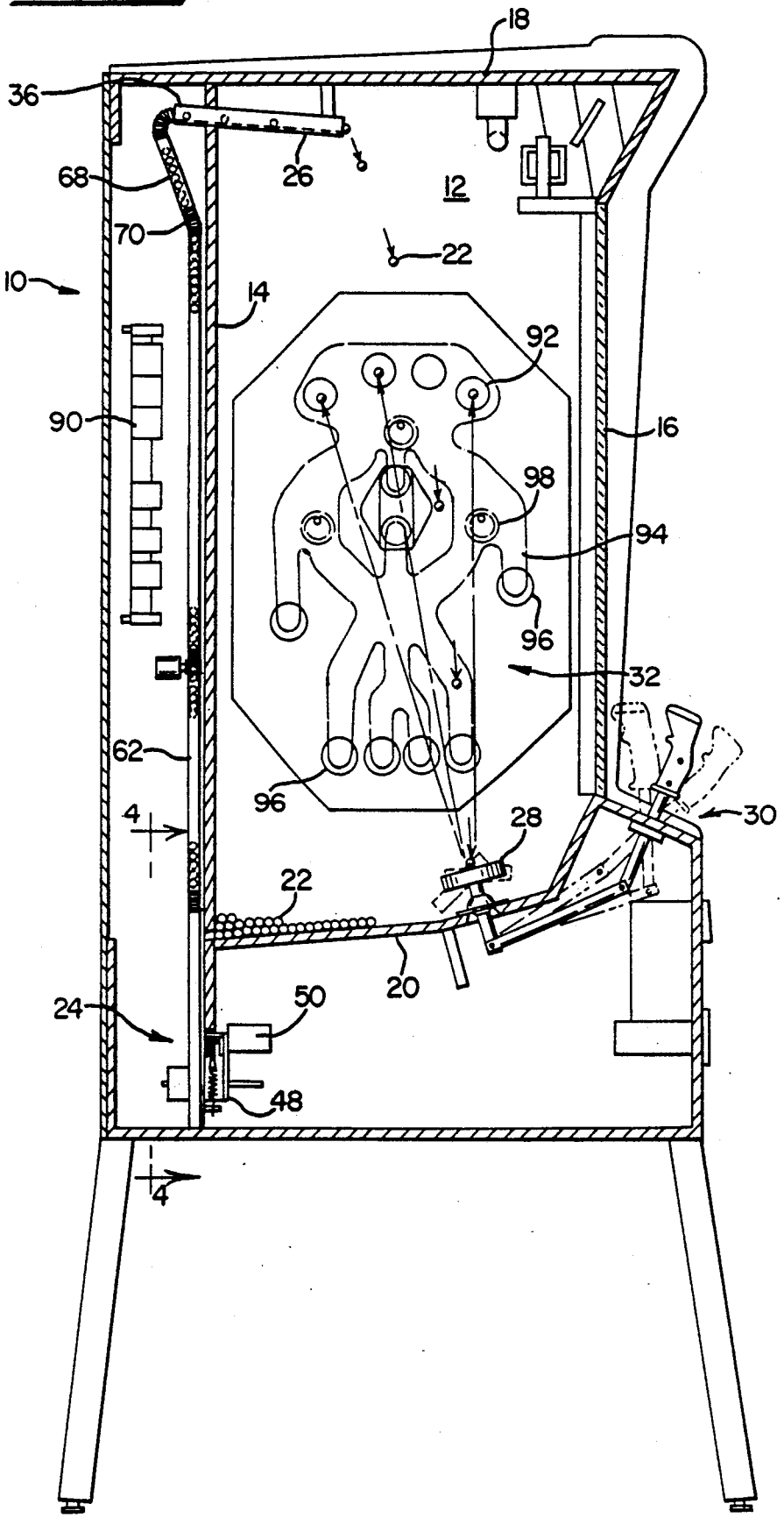
FIG. 2 is a sectional view taken along line 2—2 of FIG. 1.

Turning now to the drawings, FIGS. 1 and 2 show general views of a game 10 which incorporates a presently preferred embodiment of this invention. The game 10 is a freestanding unit including side panels 12, a back panel 14, and a transparent front panel 16. The panels 12, 14, 16 cooperate with a top 18 and a floor 20 to define an enclosure.

A large number of small steel balls 22 are contained in the enclosure, and the floor 20 directs the balls 22 into a ball pump 24 which pumps the balls upwardly to a V-shaped channel 26 from which the balls 22 are discharged. The balls discharged from the channel 26 fall in a parabolic path in space onto a steerable rebound surface 28 which is tiltably mounted adjacent to the floor 20. The orientation of the rebound surface 28 is controlled by a user by means of a steering mechanism 30 such that the user can orient the rebound surface 28 as desired in order to direct balls which bounce off the rebound surface 28 against selected targets 32. These targets 32 can be positioned on both of the sides 12 and the back panel 14 of the game 10. If desired, targets may also be positioned on the inside of the front panel, the floor or elsewhere within the enclosure.

The following discussion will take up major components of the game 10 in greater detail.

Figure 4:
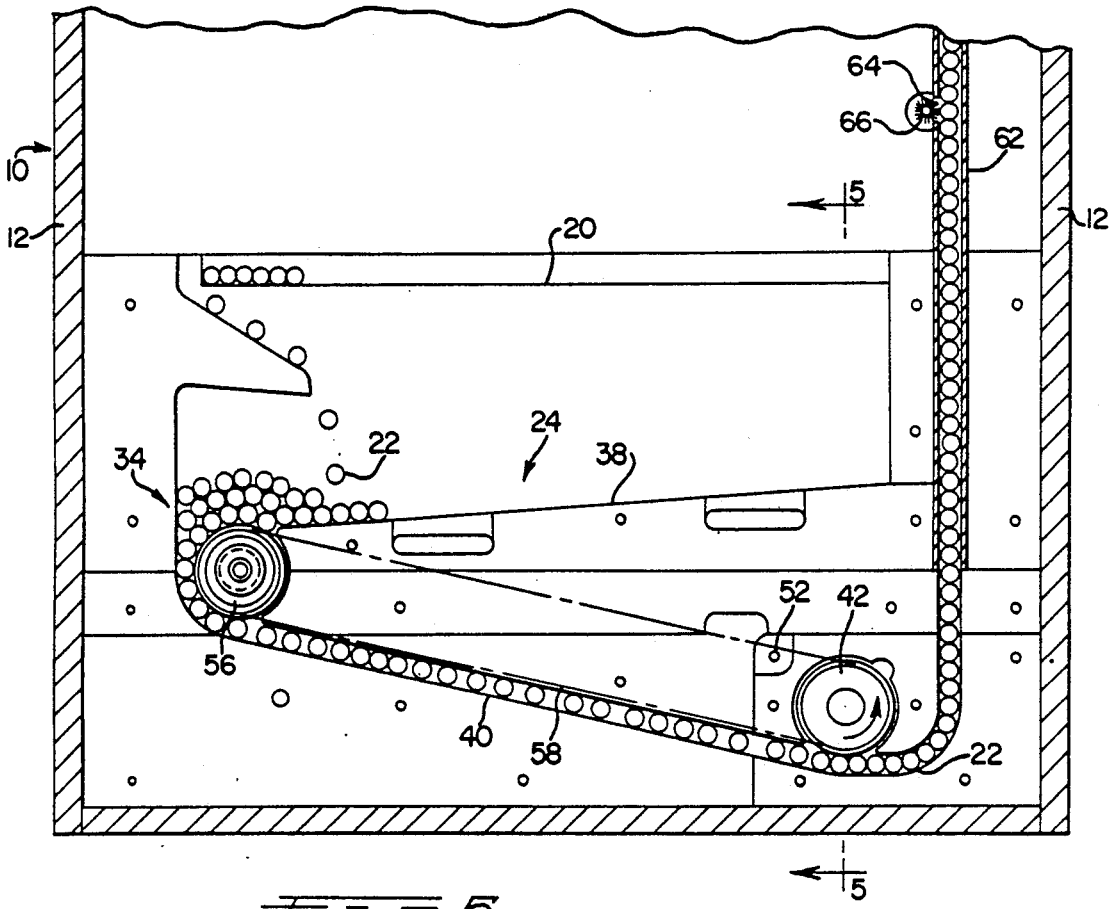
FIG. 4 is a fragmentary sectional view taken along line 4—4 of FIG. 2.
Figure 5:
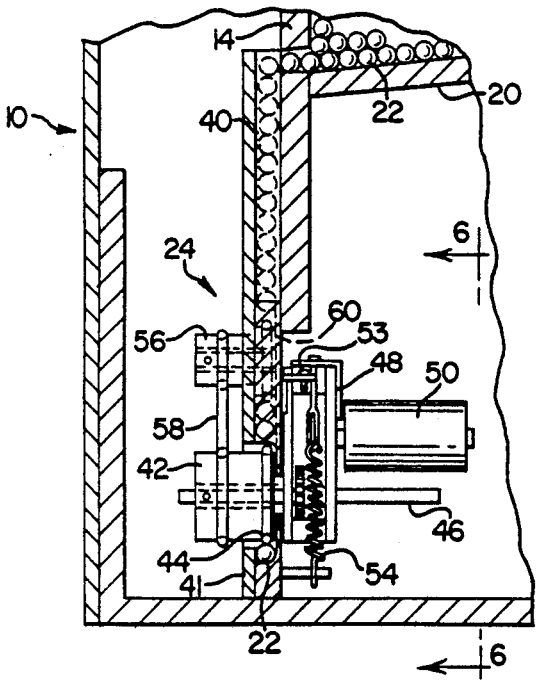
FIG. 5 is a cross-sectional view taken along line 5—5 of FIG. 4.

FIGS. 2 and 4–6 show the ball pump 24 in greater detail. The ball pump 24 includes a ball input 34 (FIG. 4) at a lower level and a ball output 36 (FIG. 2) at a higher level. The input 34 is below the level of the floor 20 and includes a shallowly tilted ramp 38. The ramp 38 in turn communicates with a ball guide 40 that receives the balls in single file. The region above the ramp 38 functions as a reservoir for the balls 22, and this reservoir extends both vertically (above the ramp 38) and horizontally (above the floor 20). At the lowest point of the guide 40, the balls are frictionally driven by a drive element 42 and advanced towards the outlet 36. The balls 22 are retained in single file in the guide 40 by a transparent overlying sheet 41 which is not apparent in FIG. 4 but is shown in FIG. 5.

Figure 6:
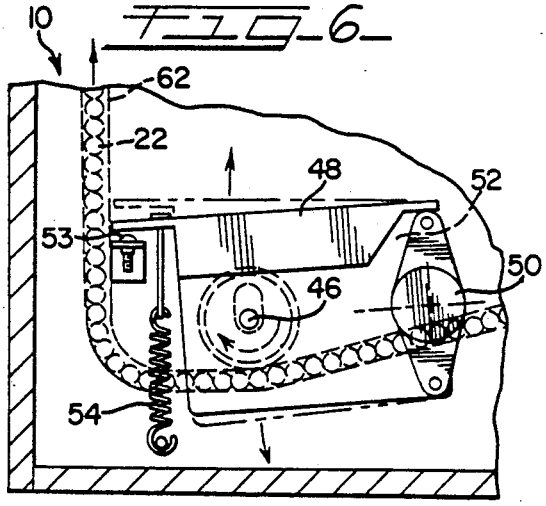
FIG. 6 is a fragmentary sectional view taken along line 6—6 of FIG. 5.

As best shown in FIG. 5 the drive element 42 is a cylindrical element having an elastomeric friction ring 44 disposed on it to contact the balls 22. The drive element 42 is mounted on an axis 46 that is in turn mounted to a gear reduction unit 48. This gear reduction unit 48 supports an electric motor 50 such that the motor 50, the gear reduction unit 48 and the drive element 42 are maintained in a fixed relationship to one another. The gear reduction unit 48 is pivotably mounted to the guide 40 to pivot about an axis 52 near the motor 50. A spring 54 resiliently biases the gear reduction unit 48 downwardly as shown in FIGS. 5 and 6 in order to bias the friction ring 44 into contact with the balls 22 in the ball guide 40. The spring 54 ensures good frictional engagement between the friction ring 44 and the balls 22, in spite of manufacturing tolerances and wear. An adjustable stop 53 limits downward travel of the gear reduction unit 48 to avoid damage to the friction ring 44 and to ensure that the friction ring 44 engages the balls 22 properly should a gap appear in the single file of balls 22 on the input side. In alternate embodiments the drive element may present teeth or cogs to drivingly engage the balls 22, instead of the friction ring 44.

A disrupter wheel 56 is mounted for rotation in the guide 40 as shown in FIGS. 4 and 5. This disrupter wheel 56 is preferably driven in rotation by a belt 58 interconnecting the drive element 42 and the disrupter wheel 56. The disrupter wheel 56 includes a friction ring 60 to improve frictional engagement between the wheel 56 and the balls 22. The purpose of the wheel 56 is to prevent the balls 22 from jamming at the entrance to the guide 40 by continually breaking up formations of the balls 22 as they are moved downwardly along the ramp 38 by the force of gravity. In alternative embodiments the disrupter wheel 56 may be driven by a second drive motor, independently of the drive element 42. Additionally, the friction ring 60 may be replaced with a ring that defines teeth or cogs shaped to break up formations of the balls 22.

The exit end of the ball guide 40 is secured to a tube 62 which extends vertically upwardly towards the output 36. As best shown in FIG. 4, the tube 62 includes a vertically oriented slot 64, and a driven cleaning brush 66 is mounted adjacent to the tube 62 to contact the balls through the slot 64. In this way dirt is continuously cleaned from the balls 22. In this example, the balls are 0.375 inches in diameter and the tube 62 defines a central opening 0.409 inches in diameter.

The tube 62 is joined at its upper end to a transversely extending tube 68 (FIG. 2) by a coil spring 70. The spring 70 has been found to provide an effective way of directing the balls 22 around the corner without jamming. Furthermore, openings between adjacent coils of the spring 70 allow dirt and debris to fall away from the balls.

The tube 68 directs the balls 22 into the discharge chute or channel 26, which is tilted slightly downwardly. As shown in FIG. 2, balls 22 are discharged from the end of the channel 26 to fall into the rebound surface 28. Horizontal and vertical adjusting screws (not shown) can be provided to adjust the position of the channel 26 is necessary to ensure that the balls 22 fall approximately at the center of the rebound surface 28. The channel 26 is shaped to stabilize the balls 22 and to guide them accurately in a repeatable path onto the rebound surface 28.

Figure 3:
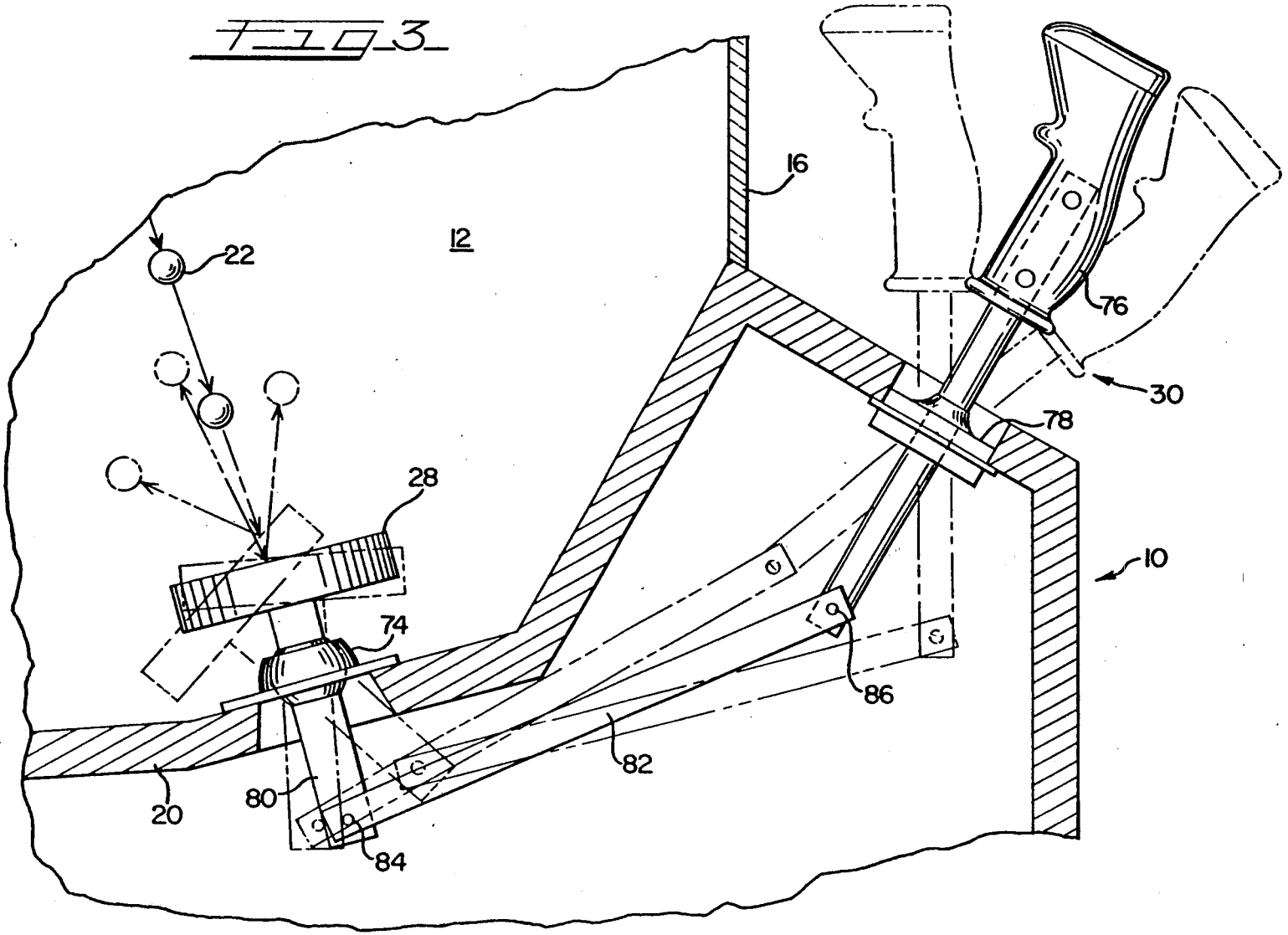
FIG. 3 is a fragmentary sectional view of the steering mechanism of FIG. 2.

Turning now to FIG. 3, the rebound surface 28 in this embodiment is a block of steel hardened to provide an elastic collision between the surface 28 and the balls 22, and to resist denting by the balls 22. The rebound surface 28 is mounted in a ball joint 74 affixed to the floor 20. The ball joint 74 allows the rebound surface 28 to move both from side to side and front to back to provide a complete range of steering.

The steering mechanism of this embodiment is best shown in FIG. 3 and includes a joy stick 76 which is pivotably mounted to the game 10 by a pivotal mount 78. The lower end of the joy stick 76 is connected to a shaft 80 by a link 82. The shaft 80 is rigidly connected to the rebound surface 28. The joints 84, 86 between the link 82, the shaft 80 and the joy stick 76 are limited to hinging motion such that the joy stick 76, the shaft 80 and the link 82 remain in the same plane. With this arrangement the user can push the joy stick 76 from side to side in order to tilt the rebound surface 28 from side to side and can move the joy stick forward and backward to tilt the rebound surface 28 forward and backward. Phantom lines are used in FIG. 3 to show alternate positions of the joy stick 76 and the rebound surface 28. As schematically indicated in FIG. 3, the user can direct balls 22 which have bounced off of the rebound surface 28 by manipulating the joy stick 76.

It should be noted that the rebound surface 28 is movably mounted beneath its center to facilitate steering by the joy stick 76. The rebound surface 28 is not used to bat the balls 22 in the manner of a flipper of a pin ball game, but rather is used to steer the rebound of the balls 22. This results in a fundamentally different feel and play than the flipper of a conventional pin ball game. Furthermore, because the rebound surface 28 does not operate as a bat, the kinetic energy of the balls 22 after they have bounced off of the rebound surface 28 is no greater than the kinetic energy of the balls 22 immediately before impact with the rebound surface 28.

Sample targets 32 are suggested at FIGS. 1 and 2. Of course, a wide range of targets can be used, including targets with graphics similar to those used on pin ball machines to enhance the appeal of the game 10. In the targets 32 of FIGS. 1 and 2, the reference numeral 92 is used to indicate openings through which the balls 22 can pass when they strike the targets 32. Once the balls have passed through the openings 92, they travel through passages 94 to discharge openings 96, from which they are returned to the floor 20. Switches (not shown) register the passage of balls through the individual passages 94, and provide electrical input signals to a scoring mechanism, schematically indicated at 90 (FIG. 2). As shown in FIG. 2, a target 32 may include moveable elements such as rings 98 in the passage 94. Such moveable elements 98 are moved by a first ball passing through the passage 94, thereby altering the configuration of the passage presented to a next ball. The foregoing description of the targets 32 has been provided merely for purposes of illustration, and is not intended to limit this invention in any way.

The game 10 is played by starting the ball pump 24 to provide a regularly spaced sequence of balls falling in space from the V-shaped channel 26 onto the rebound surface 28. For example, the balls can fall at the rate of 600 balls per minute. As the balls stream onto rebound surface 28, the user operates the joy stick 76 to steer the rebound surface 28 to direct the stream of balls towards selected ones of the targets 32. Thus, the user actually steers the rebound surface 28 in real time such that the stream of balls that have bounced off of the rebound surface 28 is directed around the interior of the game 10. The scoring mechanism 90 keeps track of the balls that have hit selected targets to provide an overall score to the user on a score readout 91. If desired, a ball sensor can be provided in the ball pump 24 to count the number of balls discharged onto the rebound surface 28 to determine the duration of play. Such a sensor can also be used to synchronize a strobe lamp positioned to illuminate the balls in play.

Of course, it should be understood that a wide range of changes and modifications can be made to the preferred embodiment described above. For example, other types of ball raising devices including devices utilizing hoppers or buckets to lift the balls can be used in substitution for the ball pump 24. Additionally, the ball pump 24 can be used in other applications, unrelated to games of the type described above.

More generally, various modifications may be made to the rebound surface 28 and its positioning arrangement. For example, the rebound surface may be non planar (either concave or convex) and may be steered through translations, rotations, tilting movements, or combinations of these movements. Steering may be accomplished via various linkages or by direct manual control of the position of the rebound surface 28. Also, the game described above may be adapted for applications in which the balls roll down a tilted surface rather than falling freely in space onto the rebound surface.

All of these variations can also be implemented as computer or video games, in which the rebound surface, the targets and the motion of the balls are simulated rather than physically realized. In the following claims, means plus function terminology is intended to encompass both physical and computer implemented embodiments, where appropriate.

It is therefore intended that the foregoing detailed description be regarded as illustrative rather than limiting, and that it be understood that it is the following claims, including all equivalents, which are intended to define the scope of this invention.

We claim:

1. In a game of the type comprising a plurality of balls, a plurality of targets responsive to interaction with the balls, and a scoring mechanism for keeping a score associated with interaction between the balls and the targets, the improvement comprising:

a movable rebound surface;

a powered raising mechanism having an input at a lower elevation and an output at a higher elevation, said raising mechanism automatically operative to raise the balls from the input to the output and to discharge the balls from the output onto the rebound surface in a regularly spaced sequence at a rate selected such that multiple balls simultaneously stream toward the rebound surface; and a user controlled steering mechanism coupled to the rebound surface to allow a user to position the rebound surface during play in order to direct the balls that bounce off of the rebound surface against selected ones of the targets.

2. The invention of claim 1 wherein the steering mechanism allows the user to reposition the rebound surface as the balls are falling.

3. The invention of claim 1 wherein the game further comprises a frame, wherein the balls fall onto a central portion of the rebound surface, and wherein the rebound surface is tiltably mounted to the frame by a ball joint positioned under the central portion of the rebound surface.

4. The invention of claim 1 wherein the steering mechanism comprises a joy stick and a linkage interconnecting the joy stick and the rebound surface.

5. The invention of claim 1 wherein the raising mechanism comprises a ball conduit, wherein the conduit comprises a pair of tubes interconnected by a coil spring, and wherein the coil spring is bent to position the tubes obliquely with respect to one another while preserving a ball passageway therethrough.

6. The invention of claim 5 wherein the conduit defines an opening therein, and wherein the invention further comprises a driven cleaning element positioned to extend into the conduit through the opening to clean the balls as they pass through the conduit.

7. The invention of claim 1 wherein the raising mechanism comprises:

a guide operative to receive the balls in single file; and a rotatable drive element mounted adjacent the guide to drivingly engage the balls and advance the balls toward the outlet.

8. The invention of claim 7 wherein the drive element is mounted for movement to and away from the guide, and wherein the raising mechanism further comprises means for biasing the drive element against the balls in the guide.

9. The invention of claim 8 wherein the raising mechanism further comprises a second rotatable element positioned adjacent an entrance to the guide to engage the balls and prevent the balls from jamming the entrance of the guide.

10. The invention of claim 1 wherein the game comprises a floor, a top, a front and at least three sides which define an enclosed volume, wherein the rebound surface is arranged adjacent the floor, wherein the front is at least partially transparent, and wherein the targets are arranged on at least the three sides.

11. The invention of claim 10 wherein the outlet is positioned near the top such that the balls descend in a parabolic path as they fall in space onto the rebound surface.

12. The invention of claim 11 wherein the steering mechanism comprises a joy stick and a linkage interconnecting the joy stick and the rebound surface.

13. The invention of claim 1 wherein the output terminates in a channel oriented to direct the balls onto the rebound surface.

14. The invention of claim 13 wherein the channel is V-shaped to stabilize the balls and guide the balls accurately onto the rebound surface.

15. The invention of claim 1 wherein the steering mechanism tilts the rebound surface to direct the balls substantially without increasing the speed of the balls.

16. In a game of the type comprising means for defining a plurality of balls, means for defining a plurality of targets responsive to interaction with the balls, and a scoring mechanism for keeping a score associated with interaction between the balls and the targets, the improvement comprising:

means for defining a movable rebound surface;

means for automatically directing the balls at the rebound surface in a regularly spaced sequence at a rate selected such that multiple balls simultaneously stream toward the rebound surface; and means, responsive to manual control, for steering the rebound surface during play to direct the balls that bounce off the rebound surface at selected ones of the targets;

said rebound surface effective to re-direct the balls substantially without increasing the velocity of the balls.

17. The invention of claim 16 wherein the directing means comprises means for raising the balls from a lower to a higher elevation and discharging the balls at the higher elevation to form a continuing sequence of balls falling in space onto the rebound surface, and wherein the steering means is operative to steer the rebound surface as the balls are falling in space.

18. The invention of claim 17 wherein the game further comprises a frame, wherein the balls fall onto a central portion of the rebound surface, and wherein the rebound surface is tiltably mounted to the frame by a ball joint positioned under the central portion of the rebound surface.

19. The invention of claim 16 wherein the steering means comprises a joy stick and a linkage interconnecting the joy stick and the rebound surface.

20. The invention of claim 16 wherein the directing means comprises means for raising the balls from a lower to a higher elevation, and wherein the raising means comprises:

guide means for receiving the balls in single file; and a rotatable drive element mounted adjacent the guide means to drivingly engage the balls in the guide means and to advance the balls towards an elevated outlet.

21. The invention of claim 20 wherein the drive element is mounted for movement to and away from the guide means, and wherein the raising means further comprises means for biasing the drive element against the balls in the guide means.

22. The invention of claim 16 wherein the game comprises a floor, a top, a front and at least three sides which define an enclosed volume, wherein the rebound surface is arranged adjacent the floor, wherein the front is at least partially transparent, and wherein the targets are arranged on at least the three sides.

* * * * *